US005843301A

United States Patent [19]

Esztergar et al.

[11] Patent Number: 5,843,301

[45] Date of Patent: Dec. 1, 1998

[54] ELECTRODYNAMIC-CHEMICAL PROCESSING FOR BENEFICIATION OF PETROLEUM RESIDUE

[75] Inventors: Ernest P. Esztergar, La Jolla, Calif.; John L. Remo, St. James, N.Y.

[73] Assignee: OCET Corporation, La Jolla, Calif.

[21] Appl. No.: 728,156

[22] Filed: Oct. 9, 1996

Related U.S. Application Data

[63] Continuation-in-part of Ser. No. 315,817, Sep. 30, 1994, abandoned.

[51] Int. Cl.[6] ..... C10C 3/00

[52] U.S. Cl. ..... 208/309; 205/695; 205/696; 204/513; 204/514; 204/554

[58] Field of Search ..... 208/309; 204/18 R, 204/513, 514, 554; 201/560, 561, 563, 573; 405/687; 205/695, 696

[56] References Cited

U.S. PATENT DOCUMENTS

| | | | |
|---|---|---|---|
| 2,029,362 | 2/1936 | Dillon | 204/24 |
| 2,031,210 | 2/1936 | Dillon et al. | 204/24 |
| 2,039,636 | 5/1936 | Dillon et al. . | |
| 2,151,318 | 3/1939 | Dillion et al. . | |
| 2,240,495 | 5/1941 | Dillon et al. | 204/305 |
| 2,261,108 | 11/1941 | Dillon et al. . | |
| 2,855,357 | 10/1958 | Stenzel . | |
| 3,129,157 | 4/1964 | Loeckenhoff . | |
| 3,196,095 | 7/1965 | Wadsworth . | |
| 3,197,393 | 7/1965 | McEuen . | |
| 3,847,775 | 11/1974 | Prestridge | 204/191 |
| 3,849,275 | 11/1974 | Candor | 204/180 R |
| 3,951,771 | 4/1976 | Burger | 204/190 |
| 3,981,789 | 9/1976 | Harrison et al. | 204/272 |
| 4,290,882 | 9/1981 | Dempsey | 210/634 |
| 4,340,466 | 7/1982 | Inooka . | |
| 4,370,223 | 1/1983 | Bose | 208/125 |
| 4,417,971 | 11/1983 | Ferrin et al. | 204/305 |
| 4,440,633 | 4/1984 | Jacquin et al. | 208/309 |
| 4,502,950 | 3/1985 | Ikematsu et al. . | |
| 4,514,272 | 4/1985 | Dubrewl et al. | 204/186 |
| 4,533,462 | 8/1985 | Billon et al. | 208/88 |
| 4,545,879 | 10/1985 | Wan et al. | 210/220 |
| 4,579,637 | 4/1986 | Jaiinghani et al. | 204/186 |
| 4,581,120 | 4/1986 | Sublette | 204/302 |
| 4,592,831 | 6/1986 | Rhoe et al. . | |
| 4,622,118 | 11/1986 | Chimenti et al. | 208/138 |
| 4,686,027 | 8/1987 | Bonilla et al. . | |
| 4,755,278 | 7/1988 | Baumgartner | 208/45 |
| 4,786,387 | 11/1988 | Whitlock . | |
| 4,820,400 | 4/1989 | Ryan et al. | 208/38 |
| 4,846,957 | 7/1989 | Johnson et al. | 208/86 |
| 4,891,131 | 1/1990 | Sadeghi et al. | 208/390 |
| 4,904,367 | 2/1990 | Ryan et al. | 208/33 |
| 4,915,819 | 4/1990 | Chirinos et al. | 208/309 |
| 4,919,793 | 4/1990 | Mallari . | |
| 5,017,281 | 5/1991 | Sadeghi et al. | 208/390 |
| 5,106,468 | 4/1992 | Chimenti . | |
| 5,420,040 | 5/1995 | Anfindsen et al. | 436/60 |
| 5,453,188 | 9/1995 | Floresen et al. | 208/214 |
| 5,476,539 | 12/1995 | Suzuki et al. | 96/44 |

OTHER PUBLICATIONS

Speight, *The Chemistry and Technology of Petroleum*, Marcel Dekker, Inc., pp. 401–403.

Kim, et al., *Characterization of Heavy Residuum by a Small Angle X–ray Scattering Technique*, Ind. Eng. Chem. Fundam., vol. 18, No. 1, 1979, pp. 60–63.

Rose, *Delayed coking—what you should know*, Hydrocarbon Processing, Jul. 1971.

Rossi, *Refinery byproduct emerges as a viable powerplant fuel*, Power, Aug. 1993, pp. 17–22.

ASTN Designation: D 893–92, *Standard Test Method for Insolubles in Used Lubicating Oils*, pp. 261–265.

*Primary Examiner*—Helane Myers

*Attorney, Agent, or Firm*—Fish & Richardson P.C.

[57] ABSTRACT

A process and system for converting petroleum residue ("resid") into a liquid product and a solid product. The resid is first mixed with a solvent having a generally nonpolar molecular character. A strong electric field is then applied to the mixture to agglomerate the asphaltenes and other large molecules in the resid. The agglomerates are then separated from the remaining liquid, thereby producing liquid and solid products. The liquid product is useful as a feedstock for petrochemicals and transportation fuels, and the solid product is suitable for combustion as a coal substitute. A portion of the liquid product may be recycled as the solvent.

48 Claims, 4 Drawing Sheets

DIRECT-CURRENT FIELD

ALTERNATING-CURRENT FIELD

SQUARE-WAVE FIELD

BIPOLAR SQUARE-WAVE FIELD

GENERAL PULSED FIELD

ELECTRODYNAMIC-CHEMICAL PROCESSING FOR BENEFICIATION OF PETROLEUM RESIDUE

RELATED APPLICATION

This application is a continuation-in-part of U.S. patent application Ser. No. 08/315,817, filed Sep. 30, 1994, now abandoned.

BACKGROUND OF THE INVENTION

1. Field of the Invention

This invention relates to petroleum refining, and more particularly to a method and system for converting petroleum residual oil (resid) into solid and liquid products.

2. Description of Related Art

Resid Structure

Oil refineries produce liquid fuels, solvents, chemicals, and lubricants from crude oil by distillation and other chemical processes, leaving a tarry black material called residual oil, or "resid". Resid is typically used for production of coke, paving and building materials, or direct end use as heavy fuel oil. These products generally have much lower value than other products of a refinery.

Resid is a complex hydrocarbon emulsion, generally comprising asphaltene micelles in an oily matrix, with resin molecules forming a surfactant. Asphaltenes are that fraction of petroleum which is insoluble in pentane but soluble in benzene, as prescribed in ASTM-D-893-92 (see 1992 Annual Book of ASTM Standards, Designation D 893–92, page 261 incorporated herein by reference.) Asphaltenes are generally polar in character, and generally include a variety of heteroatoms such as oxygen, nitrogen, sulfur, and metals. Asphaltenes can be precipitated from resid by addition of a large excess of a light aliphatic hydrocarbon solvent such as pentane. The diameter of asphaltene molecules is typically 50 to 80 Angstroms, depending on concentration and solvent used (see H. Kim and R. Long, Ind. Eng. Chem. Fundam., Vol. 18, page 60, and *The Chemistry and Technology of Petroleum*, by James G. Speight, Second Edition, 1991, page 401, incorporated herein by reference.) The oily matrix in resid is generally a mixture of light hydrocarbon molecules, including small aliphatic and aromatic molecules. Following solvent extraction of asphaltenes from resid, the deasphalted liquid is called maltene.

Related Art Processes

The most valuable petroleum products are the light condensables, such as hexane, that can be blended into gasoline. The least valuable are the heavy molecules, such as asphaltenes. In resid, the valuable condensables are bound up on side chains, in the resid structure, attached to the asphaltene molecules, or otherwise trapped in the emulsion structure. If these valuable fractions could be recovered, they would comprise an additional supply of high quality feedstock for the refinery. This would result in more transportation fuels and useful petrochemicals from a given amount of crude oil.

Much of the resid produced by refineries is subjected to coking, resulting in the liberation of hydrogen, methane, and complex hydrocarbon liquids, while generating a solid mass of petroleum coke or "petcoke". (See "Delayed Coking—What You Should Know", by K. E. Rose, in *Hydrocarbon Processing*, July 1971, page 85, incorporated herein by reference.) Coke may be used for electrodes and, with some difficulty, can be burned as a solid fuel (see Refinery Byproduct Emerges as a Viable Powerplant Fuel, by Robert A. Rossi, Power magazine, August 1991, page 16, incorporated herein by reference). Due to the low hydrogen content of coke, however, most boilers designed for burning coal of sufficient volatile reactivity cannot use coke as a substitute fuel. The lack of volatile content of coke increases ignition temperature and reduces carbon burnout.

The liquid products of coking (coker liquids) can be used as feeds to other refinery processes. However, coker liquids are less reactive in refinery processes than uncracked liquids and tend to be higher in sulfur. Coker liquids readily polymerize in secondary reactions, forming gums in processing equipment and storage vessels. Hydrogenation is used to upgrade coker liquids and reduce secondary reactions. For these reasons, coker liquids have lower values than uncracked liquids of similar molecular weight.

R. Mallari (U.S. Pat. No. 4,919,793) injects hydrogen into hot resid and feeds the resid into a coking oven. The problem with this method is that the valuable hydrocarbons are still cracked, and the process is slow. J. Bonilla et al. (U.S. Pat. No. 4,686,027) injects solvent into the resid before coking, and then extracts the solvent from the coker vapor. Although the solvent is recycled, the makeup solvent is expensive and improvements in the product are minor.

Numerous other schemes have been suggested in an attempt to extract more valuable products from resid. For example, in catalytic hydrogenation, resid is mixed with high pressure hydrogen and treated over catalysts to convert some of the resid into lighter materials. Many resid hydrogenation processes have been devised, such as that described in U.S. Pat. No. 4,340,466 to M. Inooka. However, such hydrogenation systems are very expensive to install and operate due to the high pressures and temperatures, and long residence times, in the hydrogenation reactors. Catalyst costs are also high, due to deleterious effects of metals in the resid, and operating costs are high due to the large volumes of hydrogen consumed.

Another alternative way to process resid is by solvent deasphalting, such as the process of M. Ikematsu et al (U.S. Pat. No. 4,502,950). Here a large quantity of pentane or a similar solvent is mixed with the resid, resulting in precipitation of the asphaltenes and liberation of the liquid fraction. The solid product can then be obtained by filtration, and the solvent can be recovered by fractional distillation of the remaining liquid. This process requires typically 5 to 40 times as much solvent as the resid, by mass. Use of insufficient amounts of solvent leads to poor separation of the asphaltenes. In an attempt to overcome this problem, new solvents have been proposed, such as that of A. Rhoe et al. (U.S. Pat. No. 4,592,831). However, these solvents are costly and are still required to be in excess of the amount of resid processed, and the solvent must be recovered with nearly zero loss to keep costs reasonable.

Electric fields have also been used in petroleum applications. R. Stenzel (U.S. Pat. No. 2,855,357) describes a petroleum treatment using steam injection, followed by electrostatic separation. R. Chimenti (U.S. Pat. No. 5,106,468) uses pulsed fields to separate contaminants from petroleum. D. Whitlock (U.S. Pat. No. 4,786,387) uses electrostatic separation of critical fluids in high-gradient fields. All of these techniques are expensive to employ because they require extensive processing times and use very high electric fields to overcome the stabilizing forces of the resid emulsion.

The prior art techniques, based on large quantities of solvents or on slow electrical processes, are capable of separating some resid into fractions in a laboratory setting, but would be extremely expensive and impractical if attempted on the scale of a refinery, where tons of resid must be processed every day. For this reason, it has heretofore been more economical for refineries to crack the resid in cokers, thereby salvaging some unstable liquids and some usable gases, while also generating low-value coke. The valuable liquids contained in the resid are essentially destroyed in the thermal process of coking.

Motivation

What is needed is a process to break the resid emulsion, liberate the valuable hydrocarbon liquids in an uncracked form that a refinery could use as feedstock, and coalesce the asphaltenes to form a solid coal-like fuel. The process must not completely deplete the solid product of hydrogen-bearing species that are essential for good combustion characteristics so that the solid product can be used as a salable fuel product and does not present a costly disposal problem.

Accordingly, objects of the invention are: (1) to convert resid into light hydrocarbon condensable liquids which are more valuable than those recovered from coking; (2) to produce a coal-like fuel which is more combustible than coke; (3) to make the new system readily scalable to sizes representative of refineries; (4) to ensure that the new process not consume large quantities of valuable commodities, such as exotic solvents; and (5) to eliminate disposal and processing problems associated with low-grade coke and tarry residues of petroleum, without generating additional pollution or disposal problems. Further objects of the invention will become apparent from the description provided below.

SUMMARY OF THE INVENTION

The invention comprises an electrodynamic-chemical process, and a system carrying out that process, for altering the spatial structure of asphaltenes in resid. The emulsion structure of the resid is first destabilized in a solvation step, and the asphaltenes are then agglomerated into macroscopic particles using electric fields, expelling the solvated liquid phase.

More particularly, the new process comprises the following steps:

(a) Resid from a petroleum distillation column is mixed with a solvent for that resid.

(b) An electric field is applied to the mixture to cause the asphaltenes and other large molecules to agglomerate, due to dielectric forces which are induced on the molecules by the electric field. This converts the resid-solvent mixture into an electroprocessed mixture, comprising the agglomerated asphaltenes and the remaining liquids.

(c) The electroprocessed mixture is then separated into liquid and solid fractions by any means that exerts differential forces on the fluids and the agglomerated asphaltenes.

Similarly, the new system is a means for agglomerating the asphaltenes in resid and expelling the liquid phase, including:

(a) means for mixing resid with a solvent for that resid;

(b) means for applying an electric field to the mixture to cause the asphaltenes and other large molecules to agglomerate, thereby converting the resid-solvent mixture into an electroprocessed mixture; and (c) means for separating the electroprocessed mixture into solid and liquid fractions.

The new process and system are intended to solve all of the problems discussed above, relating to prior art. The invention uses far less solvent than prior art deasphalting techniques, and can use very inexpensive solvents, including the liquid product itself, as the solvent.

The new process is extremely rapid, and the new system is readily scaled to accommodate the volume of resid produced at a refinery. In addition, the liquid product primarily comprises light condensable hydrocarbon molecules with low aromaticity and low polarity, and is suitable for conversion into transportation fuels and other products in the refinery. The solid product contains most of the large polar aromatics in the resid. The solid product also comprises volatile species essential for stable ignition and combustion of a coal-like fuel.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings refer to like elements.

DETAILED DESCRIPTION OF THE INVENTION

Figure 1:
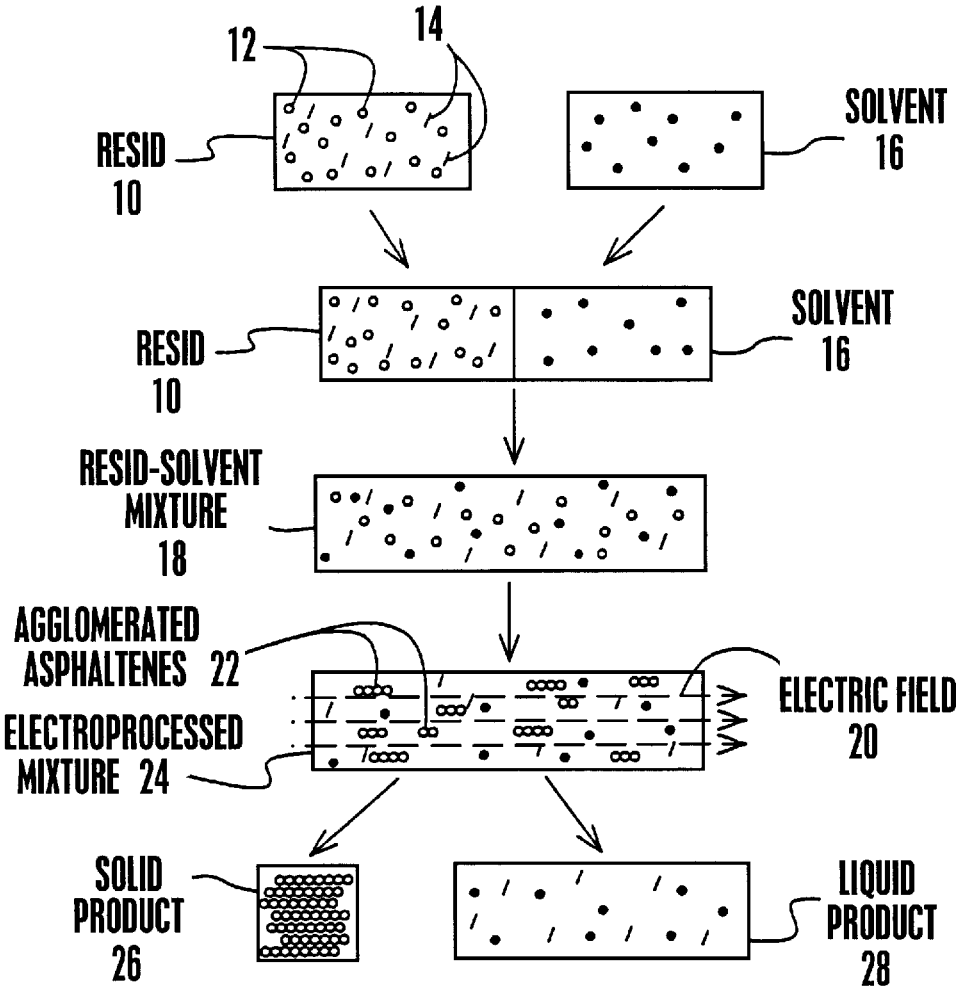
FIG. 1 is a schematic depicting the new process.

The invention is described in detail in this section, including a discussion of the mixing, the application and effects of an electric field, and the separation of liquid and solid products. The preferred embodiment of the invention is then discussed, followed by the results of experimental tests.

Mixing of Resid and Solvent

The resid input to the invention may be any petroleum refinery distillation residue, including atmospheric bottoms and vacuum bottoms, comprising asphaltenes in an emulsion-like molecular structure. The resid may be heated sufficiently for handling, but not above the boiling point of the solvent selected. The solvent is a liquid capable of forming a solution with the resid. Examples of acceptable solvents are heptane, pentane, and petroleum naphthas or gas-oil.

The solvent may be recovered from the liquid product and recycled. For example, the solvent may be separated from the liquid product by fractional distillation, one fraction being the solvent, or the whole liquid product may be used as the solvent. An advantage of this arrangement is that more solvent is generated by the process than is used, so that (after an initial cycle of the process) no makeup solvent need be added. The excess liquid product may be recycled back to the refinery to be converted into fuels and other products.

The resid-solvent mixture comprises the resid and the solvent mixed together. The amount of solvent used, or the solvent-to-resid ratio, depends on the solubility of the particular resid in the solvent selected. Sufficient solvent is required to cut the resid, reduce its viscosity, disrupt the long range order of the emulsion, and provide a relatively non-polar fluid environment to the asphaltenes. A typical range of solvent-to-resid ratios is about 1:10 to about 3:1 by weight.

The resid-solvent mixture typically is unstable. If the resid-solvent mixture is allowed to stand undisturbed for a period of days, it returns to the tarry emulsion state of the initial resid. In the solvent deasphalting technique, the precipitate is stabilized by use of a gross excess of solvent.

With the more modest amounts of solvent used in the new process, however, the solvent molecules diffuse into the asphaltene micelles over time, releasing the oils from solution and restabilizing the original emulsive state. Therefore, the asphaltenes may be rearranged into a more stable configuration in a short time, less time then required for the solvent to be incorporated into the emulsion structure. An electric field serves this purpose in the present invention.

Application of Electric Field

The resid-solvent mixture is exposed to an electric field in order to agglomerate the asphaltenes, producing a relatively stable configuration of asphaltene agglomerates suspended in a liquid medium. The electric field may be formed by placing an electrical potential difference between two or more electrodes. An electrode is any conducting member capable of emitting an electric field when placed at an electrical potential, such as a metal plate.

The electrodes are electrically connected to a voltage source by wires or other means for making electrical connections, and are electrically insulated from each other. The voltage source is a means for producing an electrical potential, such as a power supply, a battery, a pulse generator, or an oscillator. The electrodes are connected to the voltage source in such a way that at least one of the electrodes is brought to a high voltage relative to at least one other electrode. For the new system, "high voltage" means any voltage over about 100 volts.

The electric field generated between the electrodes is equal to the voltage difference between the electrodes divided by the distance between them. For example, two electrodes spaced one centimeter apart, with one electrode grounded and one electrode at a voltage of 5000 volts, will produce an electric field in free space of 5000 volts per centimeter. Alternatively, one electrode can be charged to a negative voltage and the other to a positive voltage, the electric field then being proportional to the voltage difference between the electrodes.

The voltage source may be relatively inexpensive because the power required is extremely low, despite the high voltage involved. Since the resid and solvent are excellent insulators, very little current flows between the electrodes. The electrical power delivered by the voltage source is equal to the voltage difference between the electrodes multiplied by the current that flows between them. Since this current is extremely low, the electrical power delivered by the power supply is also low.

The electric field generated between the electrodes must be sufficient to induce an electric dipole moment on the asphaltene molecules and thereby cause the asphaltenes to mutually attract. This attraction must be strong enough to overcome viscous forces and any intermolecular repulsive forces. In laboratory tests of the new process, electric fields from about 100 volts per centimeter to about 10,000 volts per centimeter and higher have been used. The upper limit for the electric field would be the point at which dielectric breakdown of the resid-solvent mixture occurs.

Effect of the Electric Field

When any material is placed in an electric field, electrons in the material are drawn toward the direction of positive electric potential. The resulting electric polarization of the material induces an electric dipole moment in each molecule. The dielectric constant of the material is a measure of the polarization caused by a given applied electric field. Typically, the dielectric constant of asphaltene is about 5.5 times that of free space, while the solvent typically has a dielectric constant of about 2.5 times that of free space. Hence the asphaltene molecules assume higher induced moments than the other molecules.

The forces between electric dipoles are angle-dependent, some forces being attractive while others are repulsive. The sign of the mutual forces depends on the relative orientation of the molecules and the applied field. Asphaltene molecules are mutually attracted to each other if a line connecting the two molecules is generally parallel to the applied electric field. If the line between the molecules is generally perpendicular to the field, the molecules mutually repel. In the new process, those asphaltenes which are in the correct relative orientation to be attracted, and which are physically close enough to each other, are swept into agglomerates. Those molecules which are mutually repelled continue to drift through the resid-solvent mixture until coming to a location more conducive to agglomeration.

The electric field may have any spatial or temporal distribution as long as the field at the asphaltenes is strong enough to cause them to agglomerate. The electric field could be uniform throughout the volume occupied by the mixture, as between two large capacitor plates, or the field could be highly nonuniform, as the field around a wire at high voltage. The field may be constant in time (a direct-current or DC electric field), the field may vary sinusoidally in time as an alternating-current (AC) field, or the field may be pulsed or varied among a number of different voltages repetitively. An advantage of DC fields is that suitable high voltage power supplies are readily available. An advantage of pulsed fields is that the asphaltene molecules may migrate between pulses to different positions, due to random thermal motions. Thus, any asphaltenes which fail to be agglomerated during one pulse may move to a different position, where attractive forces may be higher during the next pulse, thus driving the "ratchet" effect described below. On subsequent pulses, additional asphaltene agglomeration occurs. An advantage of sinusoidal AC fields is that a migration time is provided when the voltage passes through zero, and the voltage source may be a simple step-up transformer connected to standard AC power.

Agglomeration of Asphaltenes

The asphaltenes, upon being driven together by the electric forces, form a relatively stable precipitate due to bonding between asphaltene molecules. When the agglomerates are built up by successive pulses of a varying electric field, the asphaltene bonding reactions may be termed the "ratchet effect", a term reflecting the observation that the agglomerates build with successive pulses and remain intact even after the field is turned off.

The asphaltenes are mutually bonded by a large number of hydrogen bonds, polar heteroatoms, acid-base sites, partial charges, and other molecular structures. When two asphaltenes come into contact, these bonds form, permanently attaching the asphaltenes to each other.

The agglomerated asphaltenes are typically bonded closely to each other, so that solvent molecules are sterically unable to fit between them. An asphaltene molecule can be thought of as a disk-like structure with a diameter of typically 50 Angstroms and a thickness of about 10

Angstroms. Asphaltenes in an agglomerate are separated by typical bonding distances of only 1 to 2 Angstroms. The solvent molecules are typically 4 to 10 Angstroms in size, or larger, so that it is very difficult for the solvent molecules to physically reach the asphaltene bonding sites to disrupt the agglomerates. In addition, the agglomerates include thousands of asphaltene molecules in a dense and compact accumulation, further inhibiting penetration of the solvent. Furthermore, the asphaltenes are largely polar in character, and thus tend to exclude the non-polar solvent molecules.

The growing agglomerates are fractal structures, due to the chaotic nature of the agglomeration process. While the specific shape of each agglomerate can not be predicted, the agglomerates typically grow in an elongated form, the longest axis being parallel to the electric field. The reason for this is that asphaltenes in the vicinity of an agglomerate are attracted to that agglomerate only if the relative separation between the asphaltene and the agglomerate is roughly along the field direction. If the asphaltene-agglomerate separation is roughly perpendicular to the field direction, then the asphaltene will be repelled from the agglomerate by the induced electric moments of the two bodies.

As an agglomerate grows in size, its induced electric dipole moment increases as the length of the body in the direction of the field. In addition, the spatial extent of the induced field is proportional to the size of the agglomerate. Consequently, the agglomerates generate a stronger induced field, over increasingly larger spatial volumes, as the agglomerates enlarge. The agglomerates form extremely rapidly once they have achieved a sufficient size. The rate of agglomeration is thus a highly nonlinear function of time.

The rate of agglomeration is further accelerated by the overall increase in size of the agglomerating particles in the mixture. Initially, the asphaltenes are isolated molecules being drawn together by mutual induced electric forces. After some agglomeration has taken place, however, most of the asphaltenes have come together to form clusters. The agglomeration of clusters occurs more rapidly than agglomeration of individual molecules, leading to further increases in agglomeration rate.

As a further accelerating effect, the viscosity of the mixture decreases as the asphaltenes are compacted into agglomerates. The viscosities of the resid and of the resid-solvent mixture are due in part to the tangling and interference of suspended asphaltene molecules, which often contain extended side chains. When these large molecules are compressed into an agglomerate, the viscosity of the mixture reverts to that of the maltenes, which is typically much lower than the viscosity of the resid or of the resid-solvent mixture. The agglomerating asphaltenes are thus able to travel more rapidly through the medium, promoting faster agglomeration.

The resid-solvent mixture may be flowing past the electrodes while agglomeration is taking place. A small amount of turbulence in the flow may benefit the agglomeration process by conveying asphaltenes from repulsive orientations to attractive orientations in the fluid. However, the turbulence should not be so great that the agglomerates are disrupted before the asphaltenes are able to bond to them.

Other Electric Field Characteristics

In the case of pulsed electric fields, the frequency selected for the pulsing is related to the motion of the asphaltene molecules in the resid-solvent mixture. If the applied frequency is too high, the field is not effective at promoting agglomeration, because at high frequencies the voltage pulses are too brief for the asphaltenes to respond to the attractive forces and come together. On the other hand, if the frequency is too low, then only those asphaltenes in favorable relative orientations will produce dipole moments that result in mutual attraction. Unagglomerated asphaltenes remain in the mixture until they happen to drift into a different position, where mutual attraction can occur. The optimal frequency depends on the viscosity of the resid-solvent mixture, the dielectric properties of the asphaltenes, the temperature, and other factors. In laboratory tests, square wave electric fields with frequencies of about 0.5 to 2 Hz, and amplitudes of 1000 to 10,000 volts per centimeter, were found to be effective in agglomerating asphaltenes in about one minute.

The electroprocessing may be carried out in a single region of space in which the electric field is applied, or it may be carried out essentially simultaneously in multiple regions of space. In the latter case, the resid-solvent mixture is divided into a number of smaller portions, and these portions are placed among a plurality of electrodes. For example, the electrodes may be metal plates arranged in an array with a fixed spacing between adjacent plates. Alternate plates are connected to a high voltage source and the remaining plates to ground potential, so that electric fields are generated in the spaces between adjacent pairs of plates. The portions of resid-solvent mixture are placed into these spaces, and all the portions are electroprocessed simultaneously. The process is thereby sped up to accommodate large quantities of resid. Due to the very low power levels required, a single high voltage power supply is sufficient to power all of the parallel processing regions at once. Electrical hazards may be minimized by using an odd number of plates in the array and connecting the outermost plates to ground. The interior plates, at high voltage, can be protected by suitable insulation. This arrangement greatly reduces the area of exposed high voltage.

Contrast with Electrophoresis

It is to be understood that the invention is distinct from the process of electrophoresis in important ways. In electrophoresis, the motive force arises from net charges carried by the molecules under test. In an applied electric field, these charged molecules move toward one electrode or the other, depending on the sign of the molecular charge. In the new process, by contrast, no such molecular charge is required. The motive forces arise from electric dipole moments which are induced on asphaltene molecules by the applied electric field.

Electrophoresis is directly dependent on the polarity of the voltage applied, since the molecules move toward a specific electrode polarity, while in the new process the agglomeration is independent of the polarity of the applied electric field. In pulsed or rotating field electrophoresis, various molecules may be driven in different directions, but each species of molecule is driven in a specific direction, resulting in gross migration or separation of the molecules involved. In the new process, on the other hand, asphaltene molecules are attracted to each other and move toward each other, resulting in mutual approach of the attracting molecules. The molecules are not thereby driven in any specific spatial direction, in the new process, and there is no gross migration of the molecules during electroprocessing. In summary, then, electrophoresis employs non-induced monopolar charges to separate molecules, while the new process uses induced dipolar moments to agglomerate molecules.

Separation of Electroprocessed Mixture

Following the application of an electric field and the agglomeration of the asphaltenes, the electroprocessed mixture is then separated into liquid and solid products. This separation may be accomplished by any means that exerts different forces on the asphaltene agglomerates and the surrounding fluid.

Distillation is an effective way to separate the liquid and solid products. Distillation generates a condensate which typically comprises the solvent molecules, light hydrocarbons from the oily matrix of the resid, light molecules which were attached to the asphaltenes but were extracted by the solvation and agglomeration steps, and any other molecules in the mixture with a boiling point temperature between the distillation "pot" temperature and the condensation temperature of the system. The remaining unevaporated residue, comprising asphaltenes, resins, and other large molecules from the resid, is the solid product. Depending on the distillation temperature, some of the material may also escape as noncondensable vapor. This vapor is rich in hydrogen and is useful as a feedstock gas for many refinery processes.

The condensate may be recovered in multiple collection stages at different temperatures, as in fractional distillation. In this case, a plurality of different liquid products are produced.

An advantage of distillation is that the condensate can be used as the new process solvent. Since many of the polar molecules have higher boiling points than most of the nonpolar molecules in the electroprocessed mixture, and since many of the polar molecules are accumulated into large agglomerates, the condensate contains few polar molecules and can serve as a strong non-polar solvent. If polar molecules were allowed to contaminate the solvent excessively, they would tend to keep the asphaltenes in solution during electroprocessing, thereby thwarting the agglomeration step.

Alternatively, the separation may be performed by means other than distillation. For example, the products may be separated by settling or centrifugal precipitation, wherein the electroprocessed mixture is maintained in gravity or in a centrifuge for a time long enough for the agglomerates to settle out of the surrounding liquid. The separation may be performed by filtration, wherein the electroprocessed mixture is passed through a filter fine enough to trap the agglomerates. The separation process may use electrostatic separation, wherein highly inhomogeneous electric fields attract the high-dielectric components of the electroprocessed mixture, including the asphaltene agglomerates. These methods typically require less energy than distillation; however, they do not necessarily separate the polar and non-polar molecules as effectively as distillation, and thus should be used with caution when the liquid product is intended to be recycled as solvent.

Preferred Embodiment

The new process is depicted schematically in FIG. 1. Resid 10 from a petroleum refinery is input to the process. The resid 10 generally contains asphaltenes 12 (shown as small circles) and lighter and less-polar molecules, collectively referred to as condensables 14 (shown as short lines), in an emulsion-like composition.

The resid 10 is mixed with a solvent 16, which dissolves the resid 10, thereby producing a resid-solvent mixture 18. An electric field 20 (depicted with dashed arrows) is then applied to the resid-solvent mixture 18, causing the asphaltenes 12 to agglomerate due to dielectric forces. Once in contact with each other, the asphaltenes 12 bond together, forming agglomerated asphaltenes 22 (shown as clustered small circles).

The material after such agglomeration is called the electroprocessed mixture 24, comprising agglomerated asphaltenes 22, any remaining unagglomerated asphaltenes 12, condensables 14, solvent 16, plus any other molecules, if any, released from the electroprocessed mixture 24 by the salvation, electro-processing, and agglomeration processes.

The electroprocessed mixture 24 is then separated into a solid product 26 and a liquid product 28. The solid product 26 comprises mainly agglomerated asphaltenes 22, but may contain other large, non-distillable hydrocarbon molecules such as resins, long-chain paraffins, and the like. The liquid product comprises mainly condensables 14, the solvent 16, and other low-boiling-point molecules released by the asphaltenes 12 during the processing.

Figure 2:
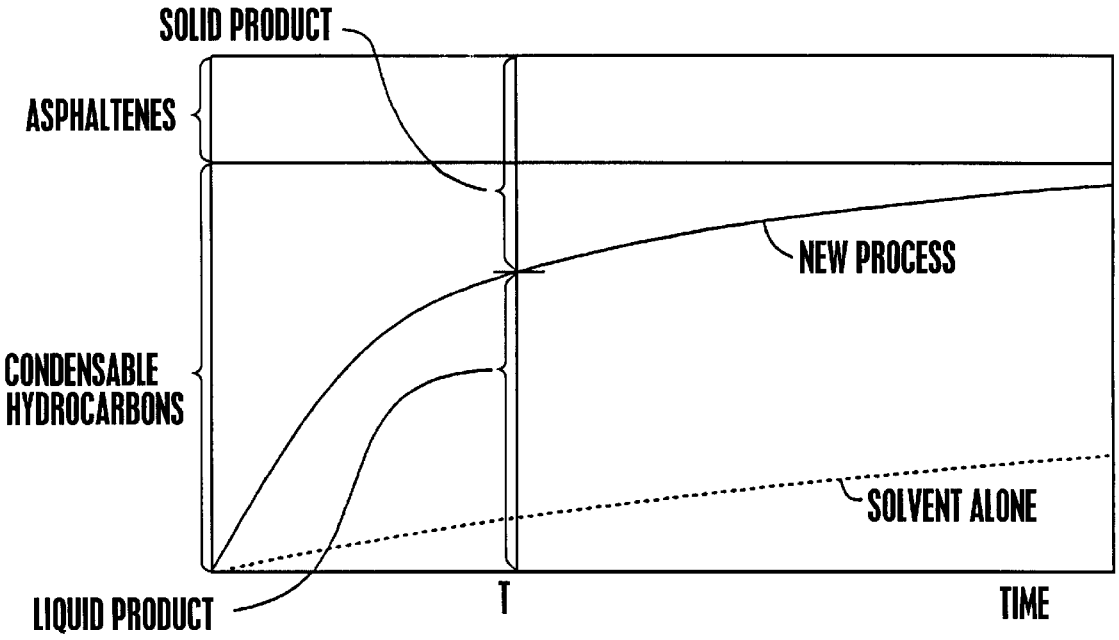
FIG. 2 is a diagram depicting the composition of the material during processing.

FIG. 2 is a schematic representation of the compositions of the initial and final materials in the new process. In this graph, the horizontal axis is the time during the processing, and the vertical axis represents quantities of materials, by weight. The resid-solvent mixture 18 is displayed initially as a mixture of asphaltenes 12, solvent 16 and condensables 14. As time progresses in the electroprocessing step, the resid-solvent mixture 18 is converted into liquids and solids comprising the electroprocessed mixture 24. Processing is halted at time T, selected to allow sufficient volatile content to remain in the solid product 26 to permit ease of combustion. The solid product 26 is shown symbolically in the figure as composed primarily of the asphaltenes 12, with a controlled amount of the condensables 14 included as shown at time T. The liquid product 28 comprises the remainder of the condensables 14.

FIG. 2 also shows how the materials behave if the processing is continued beyond time T. For longer processing times, increasing amounts of the condensables 14 are withdrawn from the solid product 26, asymptotically approaching complete segregation of the asphaltenes into the solid product 26 and condensables 14 into the liquid product 28. This is a disadvantage when the solid product 26 is required to have ease of combustibility.

FIG. 2 also shows the prior-art solvent deasphalting technique as a dotted line. The prior-art solvent process is much slower than the new process. In addition, the prior-art process is unable to achieve the degree of asphaltene precipitation that the new process provides, unless gross excesses of solvent are employed.

Figure 3:
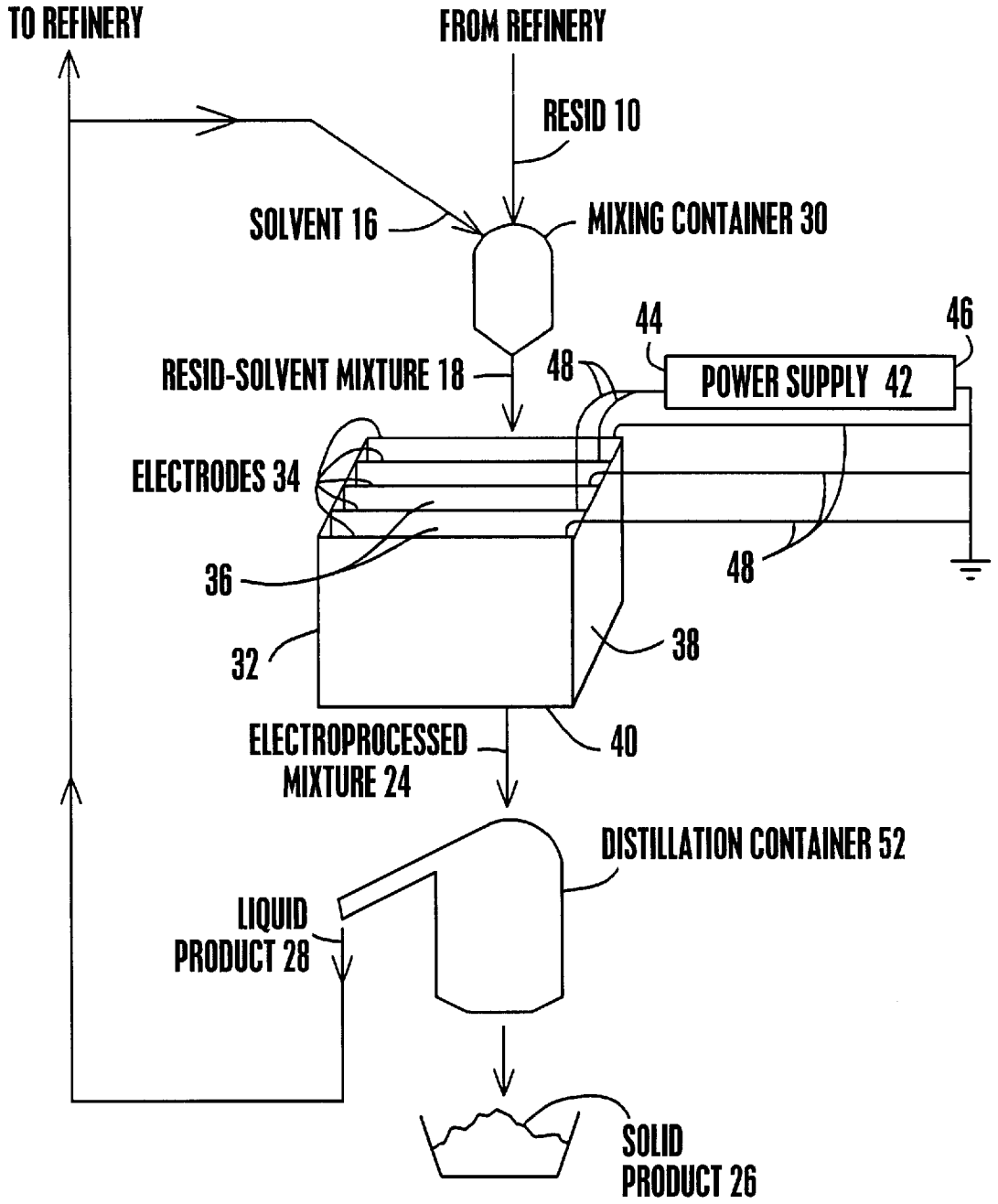
FIG. 3 is a block diagram showing an embodiment of the new system.

FIG. 3 shows an embodiment of the new system. Resid 10 is pumped into a mixing container 30, and a selected amount of the solvent 16 is added. The amount of solvent 16 is sufficient to reduce the viscosity of the mixture to a level where the mixture is easy to pump and handle at temperatures near room temperature. The solvent 16 may comprise as little as 10% by mass of the resid 10 or as much as two or three times the mass of the resid.

The resid 10 and solvent 16 are mixed by any mixing means (not shown) common to the refining art. For example, a small propeller or other stirring device may be used, or the mixing container 30 may be agitated as needed. It may also be useful to warm the resid 19 and the solvent 16 to reduce viscosity before or during the mixing. Typically such warming can be accomplished with low-cost steam. The temperature typically is below about 200° F.

After mixing, the resid-solvent mixture 18 is placed into a means for applying electric fields. In the preferred embodiment, this is an electroprocessing system 32 consisting of a number of steel plates 34 separated by a uniform separation 36. Insulating sides 38 and an insulating bottom 40 are attached to the array of plates 34 so that the resid-solvent mixture 18 is contained between the plates 34 during processing. Such an arrangement enables multiple portions of the mixture 18 to be electroprocessed simultaneously using a single power supply 42, thereby speeding up the process, increasing the rate at which resid 10 can be treated, and limiting costs.

In the embodiment of FIG. 3, alternate plates 34 are connected to a means for generating electrical potential, such as a high voltage power supply 42. In the depicted system the positive terminal 44 and the negative terminal 46 of the power supply 42 are connected to the plates 34 by electrical connection means such as copper leads 48. The positive terminal 44 is in this case the high voltage output of the power supply 42, and the negative terminal 46 is ground. The separation 36 between plates 34 is one centimeter in the illustrated embodiment, and the number of plates 34 is five. The first, third, and fifth plates are connected to the grounded side (negative terminal 46) of the power supply 42, and the second and fourth plates are connected to the high voltage end (positive terminal 44) of the power supply 42 by leads 48.

The power supply 42 preferably generates a pulsed or continuous voltage across the plates 34. In one embodiment, the power supply generates a series of 5000 volt pulses, each pulse having a pulse duration time of one second and a separation time between pulses of one second, which constitutes a one-half Hz square-wave train. The pulse risetime and falltime are each approximately one millisecond. The high voltage pulses are applied for a time sufficient to agglomerate the asphaltenes 12, in this case about one minute.

The electroprocessed mixture 24 is then separated into the solid product 26 and liquid product 28. In the preferred embodiment, the separation means is a distillation container 50. The electroprocessed mixture 24 is placed in the distillation container 50, which is heated, first at atmospheric pressure and then under vacuum, to a temperature sufficient to remove condensable liquids up to a selected boiling point. That temperature is selected so as to leave some volatile matter in the solid product, for ease of combustion, while providing as much liquid product as is feasible. In laboratory tests, the maximum temperature of distillation is typically limited to an actual temperature of about 190° F. to about 650° F., depending on the molecular properties of the resid and solvent used.

The solid product 26 is a shiny, hard, black, amorphous solid, comprising asphaltenes 12 and other large molecules such as resins. The mass of the solid product 26 is approximately 50% of the mass of the starting resid 10, depending on the temperature and duration of the distillation step and the asphaltene content of the resid 10. The hydrogen-to-carbon mass ratio of the solid product 26 is advantageously in the range of 10% to 20%, but it may be as low as 5% when high combustibility is not required of the solid product 26. Most of the heteroatoms originally in the resid 10 are in the solid product 26.

The liquid product 28 is a yellow, transparent fluid with low viscosity, low polar character, and low heteroatom content. Some of the liquid product 28 may be recycled as the solvent 16, for reuse in processing subsequent quantities of resid 10. That portion of the liquid product 28 which is not needed for use as a solvent 16 is returned to the refinery, along with any noncondensable vapors released during distillation, for conversion into refinery end products such as fuels. The amount of excess liquid product 28 available to be returned to the refinery depends on the composition of the resid 10 and on the resid-to-solvent mixing ratio. Typically, about 50% of the liquid product 28 would be recycled as the solvent 16, the remainder being returned to the refinery.

FIG. 3 also depicts a central control system 52 and shows how it is connected to the various subsystems of the processing plant. The central control system 52 adjusts the process parameters to accommodate the properties of the resid 10 and to optimize the economic value of the products. Data from various points in the process are transferred to the central control system 52, and are used as inputs to a real-time, feed-forward, predictive computer model of the plant, which controls the processing parameters.

The resid 10 is initially measured for chemical and physical properties by a resid monitor 54. The resid monitor could include, for example, a temperature measuring device, a viscometer, and a system to evaluate the asphaltene content in the resid 10. The resid monitor 54 generates resid data 56 which is transmitted to the central control system 52.

The properties of the resid-solvent mixture 18 are measured by a mixing monitor 58, which generates mixing data 60 which are transferred to the central control system 52. The mixing data 60 are then used to update the model, and the updated results of the model are used to adjust the electroprocessing parameters. An electroprocessed mixture monitor 62 then makes measurements of the properties of the electroprocessed mixture 24, generating electroprocessed mixture data 64 which are sent to the central control system 52 to enable the determination of the proper control parameters for distillation. Finally, the properties of the liquid product 28, the solid product 26, and the vapor product (not shown) are monitored by monitors (not shown), which make measurements on these respective products and send data on those measurements to the central control system 52 as a check of the effectiveness of the feed-forward model.

Also shown in FIG. 3 are control signals 66 (shown as dotted lines). The control signals 66 are generated by the central control system 52 on the basis of the comprehensive computer model. Each of the control signals 66 controls one process parameter, such as the resid-solvent mixing ratio, the electroprocessing voltage, and the distillation temperature.

As will be appreciated by those skilled in the art of refinery operations, the small number of process measurements and controls illustrated in FIG. 3 are merely illustrative of the large number of measurements and controls needed for a full-scale plant. In an actual refinery, many more measurements and many more control parameters will be desired than those listed here.

Figure 4:
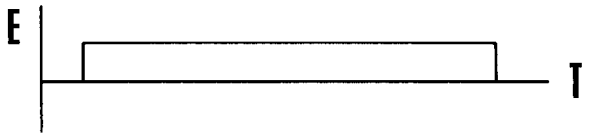
FIG. 4 shows a diagram of Direct-current field.
Figure 5:
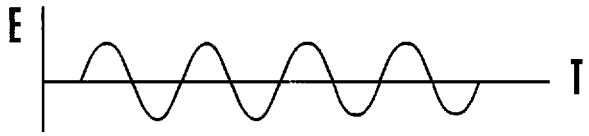
FIG. 5 shows a diagram of alternating-current field.
Figure 6:
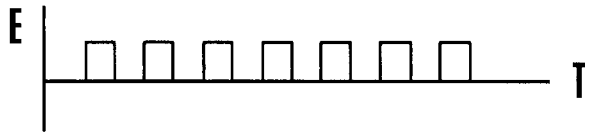
FIG. 6 shows a diagram of square-wave field.
Figure 7:
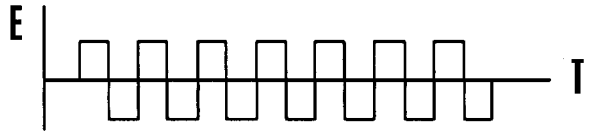
Figure 8:
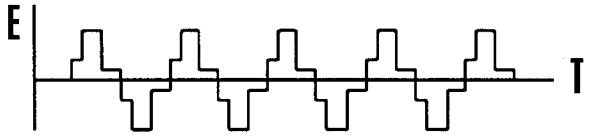
FIG. 8 shows a diagram of general pulsed field.

FIG. 4 shows a variety of waveforms which characterize the temporal variation of the electric field. Each of the 5 graphs in FIG. 4 displays the electric field along the vertical axis, and time along the horizontal axis. In graph A, a direct-current or DC field is applied to the resid-solvent mixture 18. An advantage of the DC waveform is simplicity, since DC high voltage supplies are readily available.

Graph B shows an alternating-current waveform in which the electric field varies in positive and negative directions, typically in a sinusoidal fashion. An advantage of this field is that it is easy to generate using a simple step-up transformer from AC power.

Graph C shows a square-wave field comprising flat-top pulses separated by interpulse intervals, and with risetimes and falltimes being much shorter than either the duration of the pulses or their separations. Asphaltenes are exposed to the maximum available forces when the field is on, and are free to diffuse to different locations when the field is off.

Graph D shows an alternate waveform, consisting of positive and negative pulses. Graph E shows an example of a pulsed waveform constructed by repetitively varying the field among a number of selected values.

Summary

The new process and system enable a refinery to convert resid into a coal-like fuel having greater utility and value than coke, and to recover light hydrocarbon liquids which are more readily used as refining feedstock than are coker liquids. The new process employs lower processing temperatures than coking, leading to lower capital and operating costs for the new system, relative to coking. The new process provides more valuable products than coking, while costing less. Therefore, refineries may find it economically advantageous to convert from coking operations to the new process in the future.

EXAMPLE I

As an example illustrating the technique, the results of an actual laboratory test are presented. The resid was derived from "Hondo", a heavy crude oil from an offshore oil field near Santa Barbara, Calif. The starting material was a mixture of 45.8% (by mass) of vacuum resid distilling above 1050° F., mixed with 54.2% of atmospheric resid distilling between 450° F. and 1050° F. This resid mixture contained 15.9% asphaltenes by mass.

The resid was mixed with a solvent, consisting of diesel-range gas-oil distilling between 350° F. and 650° F. Both the resid and the solvent were at room temperature. The mixture consisted of 33% solvent and 67% resid by mass. The resid-solvent mixture was then placed between two electrodes in a glass electroprocessing container. The electrodes were metal plates separated by 1 centimeter.

The mixture was then electroprocessed by applying a square-wave voltage to one of the electrodes, the other electrode being grounded. The voltage waveform had an amplitude of 5000 volts, a frequency of 0.5 Hz, and a duty factor of about 50%. The risetime and falltime of the individual pulses were approximately one millisecond. The voltage was applied for one minute.

The electroprocessed mixture was distilled, first under atmospheric pressure and then under vacuum of 0.04 atmosphere. The maximum temperature used during the distillation was 190° F. actual. The distillation produced solid and liquid products, plus a vapor product which was discarded. The amount of liquid product recovered was approximately twice the amount of solvent used. The solid product had a mass of nearly half the initial resid mass.

The liquid product was analyzed for composition, and was found to consist almost entirely of carbon and hydrogen. The hydrogen-to-carbon ratio was approximately 1:6 by mass, corresponding to an average atomic composition of $CH_2$. The liquid product contained essentially no oxygen or other heteroatoms, and included light aliphatics, light saturated or nearly saturated single-ring structures, and branched chains containing about 20 carbon atoms or less.

The solid product comprised the asphaltenes, including essentially all of the heteroatoms from the resid, and had a carbon-to-hydrogen ratio of 20:1 by mass.

The liquid product from this test was subsequently used as a solvent to dissolve a second portion of resid, and that mixture was electroprocessed as above.

This test demonstrates that: (a) the new process produces solid and liquid products from resid, (b) the liquids are condensable hydrocarbons, (c) the liquid product is a suitable solvent for the process, and (d) more liquid was produced than solvent used, so that the process may be self-sustaining, without additional solvent being required.

Although the invention has been described by the embodiments given above, modifications may be made thereto without departing from the spirit and scope of the invention, which is to be limited only by the following claims.

Throughout this description, the preferred embodiment and examples shown should be considered as exemplars, rather than as limitations on the present invention.

A number of embodiments of the present invention have been described. Nevertheless, it will be understood that various modifications may be made without departing from the spirit and scope of the invention. Accordingly, it is to be understood that the invention is not to be limited by the specific illustrated embodiment, but only by the scope of the appended claims.

What is claimed is:

1. A process for separating heavy residuum oil from petroleum refining ("resid") into a solid product and a liquid product, said resid comprising asphaltenes in combination with condensable hydrocarbon molecules, said process comprising the steps of:

(a) combining resid with a solvent for the resid to form a resid-solvent mixture;

(b) applying a uniform electric field to the resid-solvent mixture, the electric field having sufficient intensity to induce agglomeration of the asphaltenes in the resid, thereby producing an electroprocessed mixture comprising the agglomerated asphaltenes, condensable hydrocarbon molecules, and the solvent;

(c) separating the electroprocessed mixture into a solid product comprising large aromatic molecules and the agglomerated asphaltenes, and a liquid product comprising the condensable hydrocarbon molecules and the solvent.

2. The process of claim 1, further including the step of using a portion of the liquid product as the solvent.

3. The process of claim 1, further including the step of recycling the solvent by extracting the solvent from the liquid product.

4. The process of claim 1 wherein the initial solvent to resid ratio is in the range of about 1:10 to about 3:1 by weight.

5. The process of claim 1 wherein the solvent is substantially nonpolar.

6. The process of claim 1 in which the electric field is produced by at least two electrodes, and further including the steps of:

(a) electrically connecting at least one of the electrodes to a voltage source; and (b) operating the voltage source to bring at least one electrode to a high voltage relative to at least one other electrode.

7. The process of claim 1 wherein the electric field is a direct-current electric field.

8. The process of claim 1 wherein the electric field is an alternating-current electric field.

9. The process of claim 1 wherein the electric field is a square-wave electric field comprising electric pulses, each electric pulse having a risetime, a pulse duration time, a falltime, and a separation time between pulses, wherein the risetime and falltime are each much shorter than the pulse duration time or the separation time between pulses.

10. The process of claim 1 wherein the electric field is varied repeatedly among a plurality of selected electric field values.

11. The process of claim 1, further including the steps of:

(a) dividing the resid-solvent mixture into a plurality of portions;

(b) placing each portion in a region of space; and (c) generating an electric field in each of the regions of space essentially simultaneously, thereby producing the electroprocessed mixture from the resid-solvent mixture in each region of space.

12. The process of claim 11 wherein each electric field is produced by electrodes, which process further includes the steps of:

(a) arranging the electrodes in an array with a selected spatial separation between the electrodes;

(b) electrically connecting the electrodes to a voltage source having a positive terminal and a negative terminal, a first subset of the electrodes being connected to the positive terminal and a second subset of the electrodes being connected to the negative terminal, so that each electrode connected to the positive terminal is adjacent to at least one electrode connected to the negative terminal, and so that each electrode connected to the negative terminal is adjacent to at least one electrode connected to the positive terminal; and (c) operating the voltage source to generate the electric field between and among the electrodes.

13. The process of claim 1 wherein the electric field is from about 100 volts per centimeter to about the dielectric breakdown of the resid-solvent mixture.

14. The process of claim 1 wherein the electric field is applied to the resid-solvent mixture for sufficient time and at sufficient strength to agglomerate the asphaltenes in the resid.

15. The process of claim 1 wherein the solid and liquid products are separated from the electroprocessed mixture by a separation process selected from the set of: distillation, settling, centrifugation, filtration, and electrostatic separation.

16. The process of claim 1 wherein the hydrogen-to-carbon mass ratio of the solid product after separation is from about 1% to about 5%.

17. A process for rearranging the physical arrangement of asphaltenes in a mixture of resid and solvent, by applying a uniform electric field to the mixture so as to cause the asphaltenes to agglomerate, thereby producing solid agglomerates comprising the asphaltenes.

18. A process for separating heavy residuum oil from petroleum refining ("resid") into a solid product and a liquid product, said resid comprising asphaltenes in combination with condensable hydrocarbon molecules, said process comprising the steps of:

(a) combining resid with a solvent for the resid to form a resid-solvent mixture;

(b) applying a uniform electric field to the resid-solvent mixture, the electric field having sufficient intensity to induce an electric dipole moment on the asphaltenes in the resid-solvent mixture and cause the asphaltenes to mutually attract and agglomerate, thereby producing an electroprocessed mixture comprising the agglomerated asphaltenes, condensable hydrocarbon molecules, and the solvent; and (c) separating the electroprocessed mixture into a solid product comprising large aromatic molecules and the agglomerated asphaltenes, and a liquid product comprising the condensable hydrocarbon molecules and the solvent.

19. The process of claim 18, further including the step of using a portion of the liquid product as the solvent.

20. The process of claim 18, further including the step of recycling the solvent by extracting the solvent from the liquid product.

21. The process of claim 18 wherein the initial solvent to resid ratio is in the range of about 1:10 to about 3:1 by weight.

22. The process of claim 18 wherein the solvent is substantially nonpolar.

23. The process of claim 18 in which the electric field is produced by at least two electrodes, and further including the steps of:

(a) electrically connecting at least one of the electrodes to a voltage source; and (b) operating the voltage source to bring at least one electrode to a high voltage relative to at least one other electrode.

24. The process of claim 18 wherein the electric field is a direct-current electric field.

25. The process of claim 18 wherein the electric field is an alternating-current electric field.

26. The process of claim 18 wherein the electric field is a square-wave electric field comprising electric pulses, each electric pulse having a risetime, a pulse duration time, a falltime, and a separation time between pulses, wherein the risetime and falltime are each much shorter than the pulse duration time or the separation time between pulses.

27. The process of claim 18 wherein the electric field is varied repeatedly among a plurality of selected electric field values.

28. The process of claim 18, further including the steps of:

(a) dividing the resid-solvent mixture into a plurality of portions;

(b) placing each portion in a region of space; and (c) generating an electric field in each of the regions of space essentially simultaneously, thereby producing the electroprocessed mixture from the resid-solvent mixture in each region of space.

29. The process of claim 28, wherein each electric field is produced by electrodes, which process further includes the steps of:

(a) arranging the electrodes in an array with a selected spatial separation between the electrodes;

(b) electrically connecting the electrodes to a voltage source having a positive terminal and a negative terminal, a first subset of the electrodes being connected to the positive terminal and a second subset of the electrodes being connected to the negative terminal, so that each electrode connected to the positive terminal is adjacent to at least one electrode connected to the negative terminal, and so that each electrode connected to the negative terminal is adjacent to at least one electrode connected to the positive terminal; and (c) operating the voltage source to generate the electric field between and among the electrodes.

30. The process of claim 18 wherein the electric field is from about 100 volts per centimeter to about the dielectric breakdown of the resid-solvent mixture.

31. The process of claim 18 wherein the electric field is applied to the resid-solvent mixture for sufficient time and at sufficient strength to agglomerate the asphaltenes in the resid.

32. The process of claim 18 wherein the solid and liquid products are separated from the electroprocessed mixture by a separation process selected from the set of: distillation, settling, centrifugation, filtration, and electrostatic separation.

33. The process of claim 18 wherein the hydrogen-to-carbon mass ratio of the solid product after separation is from about 1% to about 5%.

34. A process for separating heavy residuum oil from petroleum refining ("resid") into a solid product and a liquid product, said resid comprising asphaltenes in combination with condensable hydrocarbon molecules, said process comprising the steps of:

(a) combining resid with a solvent for the resid to form a resid-solvent mixture;

(b) applying a uniform electric field to the resid-solvent mixture, the electric field having an intensity in the range of about 100 volts per centimeter to about the dielectric breakdown of the resid-solvent mixture, the electric field inducing agglomeration of the asphaltenes in the resid, thereby producing an electroprocessed mixture comprising the agglomerated asphaltenes, condensable hydrocarbon molecules, and the solvent; and (c) separating the electroprocessed mixture into a solid product comprising large aromatic molecules and the agglomerated asphaltenes, and a liquid product comprising the condensable hydrocarbon molecules and the solvent.

35. The process of claim 34, further including the step of using a portion of the liquid product as the solvent.

36. The process of claim 34, further including the step of recycling the solvent by extracting the solvent from the liquid product.

37. The process of claim 34 wherein the initial solvent to resid ratio is in the range of about 1:10 to about 3:1 by weight.

38. The process of claim 34 wherein the solvent is substantially nonpolar.

39. The process of claim 34 in which the electric field is produced by at least two electrodes, and further including the steps of:

(a) electrically connecting at least one of the electrodes to a voltage source; and (b) operating the voltage source to bring at least one electrode to a high voltage relative to at least one other electrode.

40. The process of claim 34 wherein the electric field is a direct-current electric field.

41. The process of claim 34 wherein the electric field is an alternating-current electric field.

42. The process of claim 34 wherein the electric field is a square-wave electric field comprising electric pulses, each electric pulse having a risetime, a pulse duration time, a falltime, and a separation time between pulses, wherein the risetime and falltime are each much shorter than the pulse duration time or the separation time between pulses.

43. The process of claim 34 wherein the electric field is varied repeatedly among a plurality of selected electric field values.

44. The process of claim 34, further including the steps of:

(a) dividing the resid-solvent mixture into a plurality of portions;

(b) placing each portion in a region of space; and (c) generating an electric field in each of the regions of space essentially simultaneously, thereby producing the electroprocessed mixture from the resid-solvent mixture in each region of space.

45. The process of claim 44, wherein each electric field is produced by electrodes, which process further includes the steps of:

(a) arranging the electrodes in an array with a selected spatial separation between the electrodes;

(b) electrically connecting the electrodes to a voltage source having a positive terminal and a negative terminal, a first subset of the electrodes being connected to the positive terminal and a second subset of the electrodes being connected to the negative terminal, so that each electrode connected to the positive terminal is adjacent to at least one electrode connected to the negative terminal, and so that each electrode connected to the negative terminal is adjacent to at least one electrode connected to the positive terminal; and (c) operating the voltage source to generate the electric field between and among the electrodes.

46. The process of claim 34 wherein the electric field is applied to the resid-solvent mixture for sufficient time and at sufficient strength to agglomerate the asphaltenes in the resid.

47. The process of claim 34 wherein the solid and liquid products are separated from the electroprocessed mixture by a separation process selected from the set of: distillation, settling, centrifugation, filtration, and electrostatic separation.

48. The process of claim 34 wherein the hydrogen-to-carbon mass ratio of the solid product after separation is from about 1% to about 5%.

* * * * *